US006185763B1

(12) United States Patent
Hennessy

(10) Patent No.: US 6,185,763 B1
(45) Date of Patent: Feb. 13, 2001

(54) HAMMOCK

(76) Inventor: Thomas Francis Hennessy, Southwind Rd., Galiano B.C. (CA), Von Ipo ( * ) Notice: Under 35 U.S.C. 154(b), the term of this patent shall be extended for 0 days.

(21) Appl. No.: 09/262,448

(22) Filed: Mar. 4, 1999

(30) Foreign Application Priority Data

Sep. 14, 1998 (CA) ..... 2246971

(51) Int. Cl.[7] ..... A45F 1/06
(52) U.S. Cl. ..... 5/120; 5/121; 5/122; 5/128
(58) Field of Search ..... 5/120, 121, 122, 5/127, 128; 297/273, 277

(56) References Cited

U.S. PATENT DOCUMENTS 773,317 * 10/1904 Funke ..... 5/122
955,281 * 4/1910 Norwood ..... 5/121
4,320,542 * 3/1982 Cohen ..... 5/121
4,686,720 * 8/1987 Newell ..... 5/121
5,729,844 * 3/1998 Kerstetter ..... 5/120

* cited by examiner

*Primary Examiner*—Terry Lee Melius
*Assistant Examiner*—Fredrick Conley
(74) *Attorney, Agent, or Firm*—Shoemaker and Mattare, Ltd.

(57) ABSTRACT

A hammock which comprises a bed having an entrance slit, situated in the same vertical plane as its longitudinal axis of symmetry and located on one side of its center of symmetry. The bed is provided with a self closing feature for the entrance slit. This feature is located at the mid point of the bed's short side, where the entrance slit begins. The bed has a bundle of gathered folds, situated at both its ends. The bundle is made of each short side of a rectangular sheet which forms the bed. A ridge line goes through each opposite bundle of gathered folds, where it is connected to each suspending rope.

5 Claims, 8 Drawing Sheets

HAMMOCK

FIELD OF THE INVENTION

This invention relates to hammocks, particularly one provided with a different manner of entrance, attachment for suspending, sag adjustment, form of bed, insect net and canopy.

BACKGROUND OF THE INVENTION

For camping and other recreational activities, different hammocks have been developed to provide shelter from insects, ground dwelling creatures and inclement weather. Being suspended above the ground, hammocks provide a more comfortable, dry, warm and clean surface than do tents.

Existing hammocks are entered by climbing over one side. This is difficult and sometimes dangerous, because the hammock is out of balance when a person enters it. The potential occupant pushes down one of the higher sides of the hammock, as low as possible, towards its longitudinal axis of symmetry, to allow his access. As soon as the occupant sits down and his weight comes off of his feet, the hammock swings back into its original position, tumbling the occupant backwards, without always remaining inside the hammock.

The entrance in an enclosed hammock which is usually between the bed and insect net, is normally closed by a zipper. The zipper is tensioned and is easily damaged, if it is not fully opened before entry. If the zipper is damaged, the hammock can no longer provide protection from insects, it is known also that a zipper in an enclosed hammock is its most vulnerable feature.

In known hammock designs, wherein each suspending rope is attached to the hammock through a sewn sleeve at each end, all of the occupant's weight is transmitted to the stitches of the sewn sleeve. If one or several stitches are overloaded, they can fail and the entire stitching can unravel under the weight of the occupant. If the stitching is stronger than the fabric fibres, concentration of tension at one point could cause the material to fail, starting a tear which would open quickly and and not stop until the occupant reaches the ground.

Hammock sag until now had to be adjusted by trial and error, by adjusting the suspending ropes during joining to their anchors. If the suspending ropes at each end of the hammock are so attached that too much slack is present, the resulting sag will also be increased. In this situation, the occupant will be bent, and hence in an uncomfortable position. If the suspending ropes at each end of the hammock are pulled too tightly the sag will be reduced too much. In this situation trying to climb into the hammock is difficult and dangerous.

Hammocks of rectangular and trapezoidal shape are known. They allow a relatively restricted movement of occupant's arms and hands and they do not comply with the requirement that in the middle of the hammock, where the occupant is wider, the hammock must be wider as well.

Attempts have been made to address and solve the existing concerns.

But it is apparent that up to the present time, there remain important shortcomings in hammocks.

Thus, U.S. Pat. No. 5038428, dated Aug. 13, 1991, granted to Shur for a "Hammock having a pillow and incision" discloses a pillow and a slit added to an otherwise conventional hammock. The pillow is mounted atop the hammock, adjacent to the longitudinal edge mid-length of the hammock, so that the transverse axis of symmetry of hammock bisects the pillow. The incision has a predetermined longitudinal extent and is also positioned mid-length of the slit are on opposite sides of the longitudinal axis of symmetry of the hammock. A first individual standing in the incision may massage a second recumbent individual, whose head is supported by a pillow and whose feet may extend below the hammock or may rest atop the hammock on opposite sides of the first individual.

The disclosed hammock is not designed for general use, but for a very specific one. The central location of the incision on one side of the longitudinal axis of symmetry of the hammock, does not allow a proper entry of an occupant.

U.S. Pat. No. 4,686,720 dated Aug. 18, 1987, granted to Nowell for a "Covered hammock", discloses a hammock comprising a lower support which is sewn to an upper cover. The lower support is cut in a trapezoidal shape and the wide part is intended to accommodate occupant's head and shoulders, the narrower lateral end being slightly gathered. A strip of fabric is sewn to the gathered fabric. The strip as well as the material of the lower fabric support, at the wide end, is folded over twice, sewn down and grommets are placed at intervals in the folded strip.

A first shortcoming of the above invention resides in the fact that the trapezoidal form of the lower support does not satisfy the occupant's requirement to have a sense of space in the middle of the hammock and to allow the free movement of his arms and hands. A second shortcoming resides in the fact that the end attachments uses sewn fabric.

U.S. Pat. No. 4,001,902, dated Jan. 11, 1977, granted to Haii et al. for a "Suspended bed and shelter" discloses a combination comprising a hammock, an insulated sleeping bag and a tent. The hammock consists of a cloth of rectangular shape with a pocket, loop or similar device, at each end, to accommodate a spreader bar of rigid material, such as wood or light metal. Attached at two or more points to each spreader bat is a stringing assembly of approximately 4" to 5" in length which leads to a single point, such as a metal ring, which, in turn, is attached by a rope to a tree. The tent is held in position over the hammock and sleeping bag by a separate ridge line attached to the same trees.

As can be seen, the manner of attaching the combination bed and shelter, by using a pocket or loop at the end of the hammock, a spreader bar and a stringing assembly, is complicated. The attachment is composed of too many features and it is possible to have a weak link in it which could compromise the whole attachment assembly. With respect to the ridge line, besides the fact that it does not participate in the sag adjustments, is joined separately to the trees.

SUMMARY OF THE INVENTION

It is apparent that up to the present time there remain significant defects in hammocks. There is accordingly a need for a hammock which overcomes the disadvantages of the prior art.

The present invention is directed broadly, to a hammock which includes a bed having an entrance slit, situated in the same vertical plane as its longitudinal axis of symmetry and located on one side of its centre of symmetry. This bed includes as well a self-closing feature for the entrance slit, located at midpoint of its short side, where said entrance begins. This bed comprises as well a bundle of gathered folds, situated at both of its ends and made of each short side of a rectangular sheet which forms the bed. The bundle of gathered folds is used to fasten the hammock, by suspending ropes, to anchors. This bed includes a ridge line for adjusting the sag of the hammock. The ridge line extends in the vertical plane, plane which contains the longitudinal axis of symmetry, and goes through each opposite bundle of gathered folds, where it is connected to each suspending rope. A side adjustment cord of the rectangular sheet has one end attached to the middle of each longitudinal side of the rectangular sheet, the other end being fastened to a fixed element, one side adjustment cord being provided at each side of the hammock. This hammock has a lozenge shape as viewed from the top. This shape is formed when the opposite side adjustment cords are outwardly stretched and opposite suspending ropes are tensioned. This bed has a canopy cut in a lozenge form from a sheet of material. At each side of the canopy, where two concurrent edges of the lozenge form intersect the transversal axis of symmetry, an adjustably extending cord is attached. In one aspect of this invention, the hammock has a bed which includes an entrance slit, situated in the same vertical plane as its longitudinal axis of symmetry and located on one side of its centre of symmetry. The entrance slit extends from one of the short sides of the rectangular sheet of flexible material from which it is made to a point short of its centre of symmetry.

The above disclosed bed of this hammock comprises as well a selfclosing feature which is obtained by folding together several times, and then, holding in place, the edges of the entrance slit closes to the corresponding short side of the substantially rectangular sheet of material, where the slit extends.

In another aspect of the invention, the hammock has a bed including a number of gathered folds, situated at both of its ends and made of each short side of a substantially rectangular sheet which forms the bed. The bundle of gathered folds is used to fasten the hammock by suspending ropes, to anchors. The bundle of gathered folds is made of each short side of the substantially rectangular sheet, which short side is folded several times parallel to the longitudinal axis of the rectangular sheet. The first fold is made towards the longitudinal axis and consists essentially of two layers, followed by a second fold of four layers, then eight layers and, finally, sixteen layers.

Two resulting bundles of sixteen layers are folded together to form one bundle of gathered folds of thirty two layers of material, which are fastened together permanently, and in which one or more holes for suspending ropes are made.

An accordion type of folding is an alternative solution. The folds of this accordion type of folding are fastened permanently and provided with one or more holes for attaching suspending ropes.

In another aspect of the invention, the hammock comprises a bed which includes for adjusting its sag, a ridge line extending in a vertical plane, which plane includes the hammocks's longitudinal axis of symmetry and going to the hammock ends, where is adapted to be attached individually to suspending ropes.

In another aspect of this invention, the hammock comprises a bed including, for adjusting its sag, a ridge line extending in a vertical plane, which plane includes the hammock's longitudinal axis of symmetry and, after passing throughout each of the hammock's ends, where it is fastened, continues as a suspending rope. This bed has, for altering its sag, according to individual comfort requirements, a workable adjustable length. The adjustment is obtained by tying one end of the ridge line and retying again to a shorter or longer length.

An adjustment device is used in combination with a part of the ridge line which is intended as a slacked portion. This part is unwrapped or wrapped accordingly around the sag adjustment device, when the ridge line is not under tension. By this, the extension of the slacked portion and consequently, the resulting number of subtracted or added wraps determines the workable length of the ridge line.

In another aspect of this invention, the hammock comprises a bed including a side adjustment cord attached at one end to the middle of each longitudinal side of a substantially rectangular sheet from which the bed is made, the other end being fastened to a fixed element. The adjustment cord is provided at each side of the hammock. This hammock has, a lozenge shape, viewed from the top, formed when opposite side adjustment cords are outwardly stretched and opposite suspending ropes of the hammock are tensioned.

In another aspect of this invention, the hammock comprises a bed which includes a canopy made in a lozenge form from a sheet of substantially synthetic material, to which canopy an adjustably extending cord is attached with one end where two concurrent edges of the lozenge intersect the transversal axis of the sheet from which the canopy is made. The other end of the adjustably extendible cord is joined to a fixed feature. Each two concurrent edges of the lozenge form sheet, at their point of intersection with the longitudinal axis of the sheet is attached to a suspending rope of the hammock.

BRIEF DESCRIPTION OF THE DRAWINGS

The concept and practical aspects of the invention are apparent from the purely exemplary, and therefore not restrictive, embodiments illustrated in the following drawings, in which.

DETAILED DESCRIPTION OF THE PREFERRED EMBODIMENT

Figure 1:
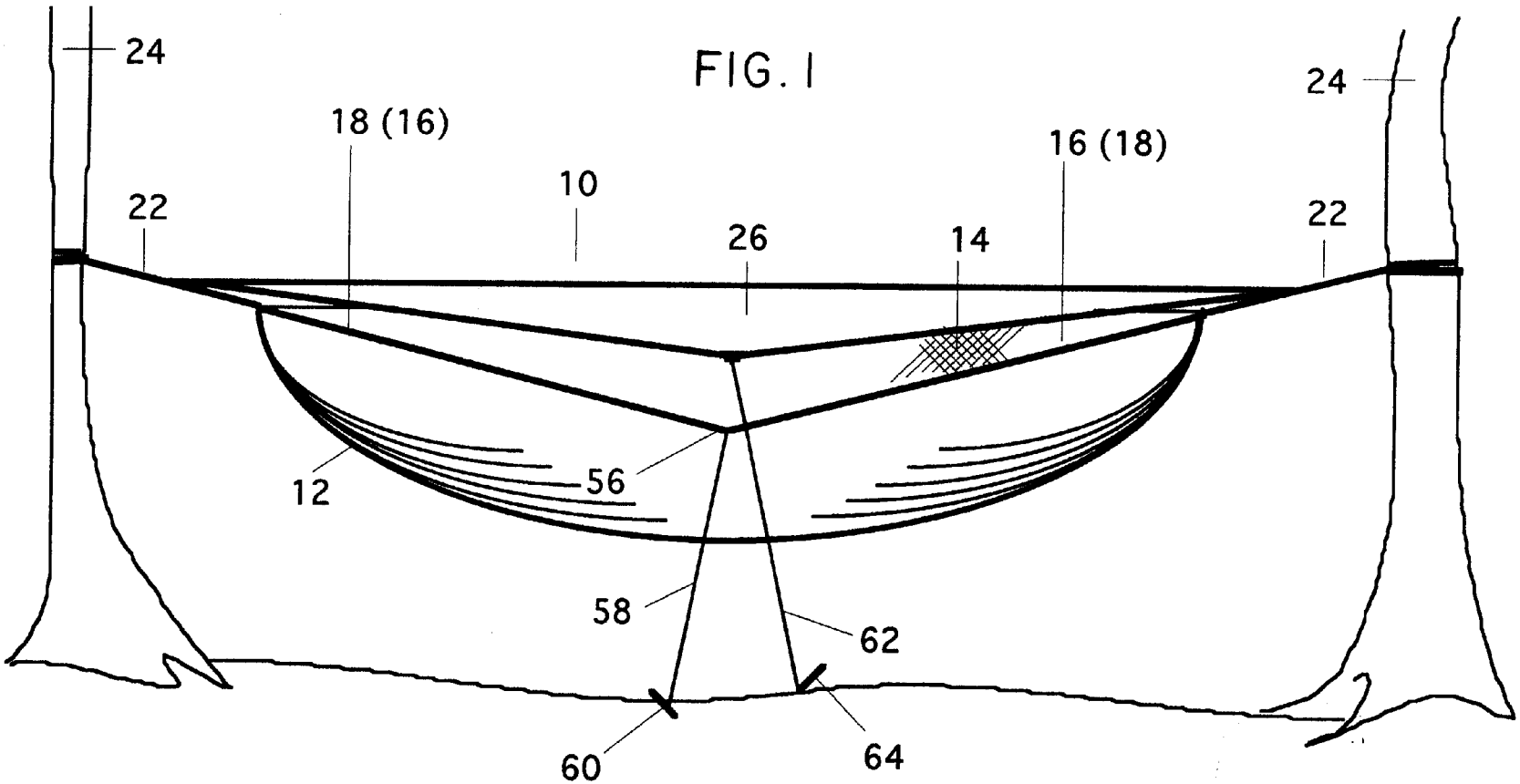
FIG. 1 illustrates schematically a side elevation of the hammock comprising the bed, insect net and canopy.
Figure 2:
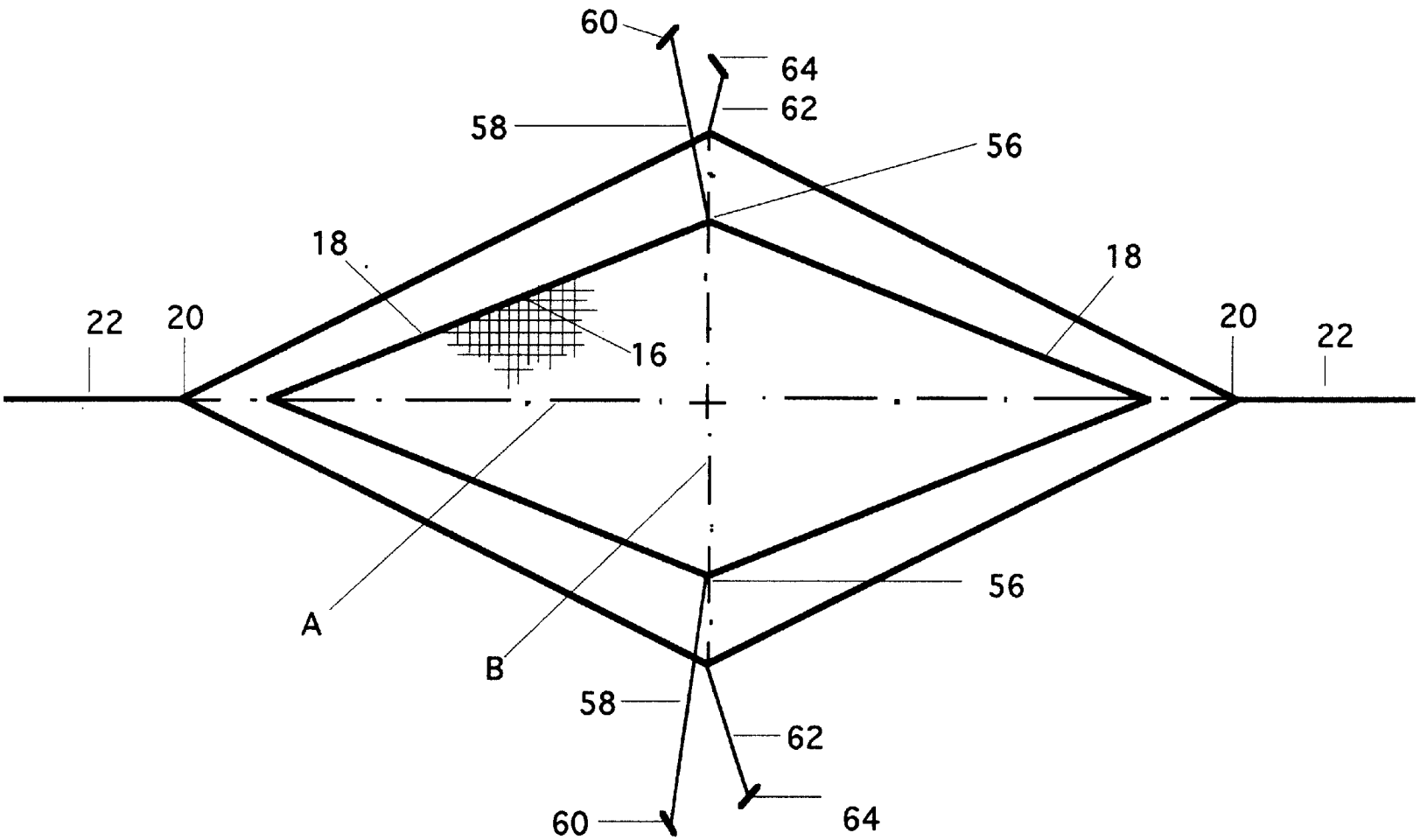
FIG. 2 illustrates schematically a top view which depicts the lozenge form of the bed, insect net and canopy.

Referring in the detail now to the drawings, wherein similar parts of the invention are identified by like reference numerals, there is seen a hammock, generally illustrated as 10(FIG. 1)

Hammock 10 comprises a bed 12, an insect net 14 which is located above bed 12 and is attached along its edges 16 to longitudinal sides 18 of bed 12. Each end 20 of bed 12 is joinable with a suspending rope 22 to a spaced anchor 24.

A canopy 26 overhangs insect net 14.

Figure 3:
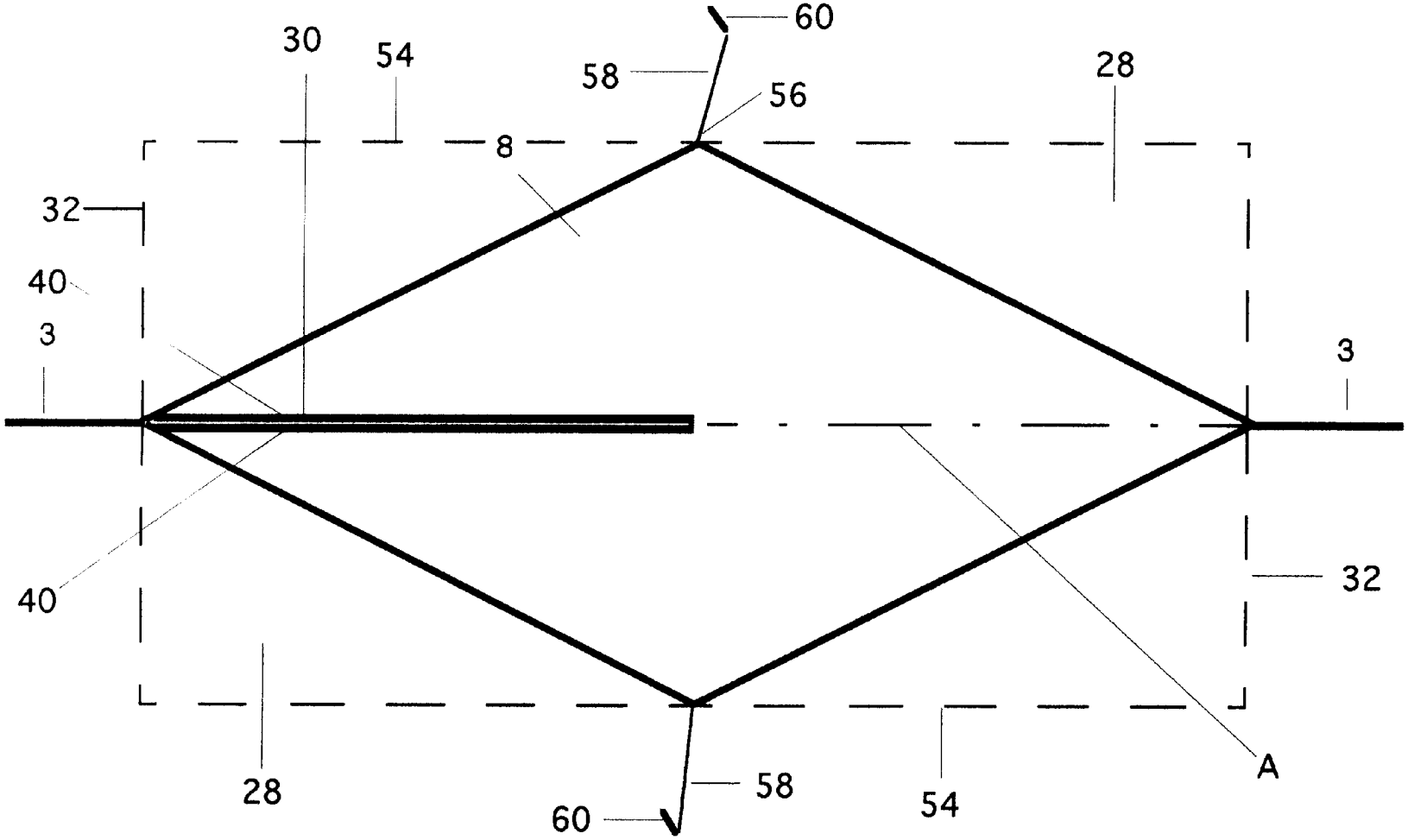
FIG. 3 illustrates schematically a plan view of the bed with its lozenge form and the rectangular sheet of material, from which the bed is made.
Figure 4:
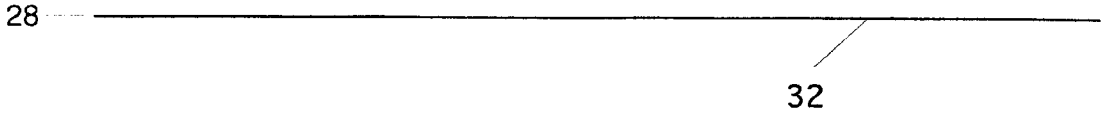
FIGS. 4 to 9 illustrate a sequence of end view schematic elevations depicting the operational steps for making the bundle of gathered folds.

Bed 12, dimensioned to provide accommodation for one or more persons, is made from a substantially rectangular sheet 28(see FIG. 3) of flexible breathable material. It must be of sufficient strength and resilience to withstand an appropriate load and repeated use under varying conditions. Nylon, polyester or a synthetic material with similar qualities is used.

Figure 5:
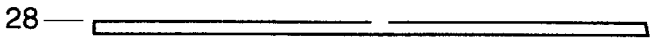
Figure 6:
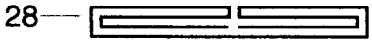
Figure 7:
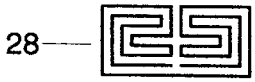
Figure 8:
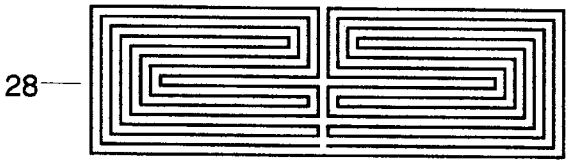
Figure 9:
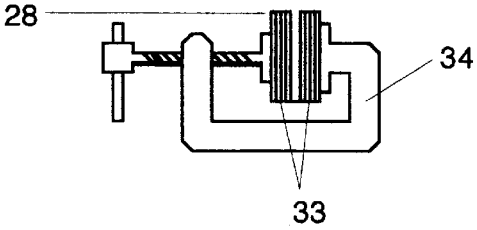

An entrance slit 30, situated in the same vertical plane as bed's 12 longitudinal axis of symmetry A, extends from one of the short sides 32 of a substantially rectangular sheet 28 to a point short of the center of symmetry of bed 12. Short side 32, opposite entrance slit 30, of rectangular sheet 28 (see FIGS. 4 to 9) is folded several times parallel to longitudinal axis A of sheet 28 The first fold of two layers of material is made towards the longitudinal axis of sheet 28(see FIG. 5). Then, in the same manner, rectangular sheet 28 is folded in four layers(FIG. 6). Next, in eight layers(FIG. 7) and then sixteen layers(FIG. 8).

Figure 10:
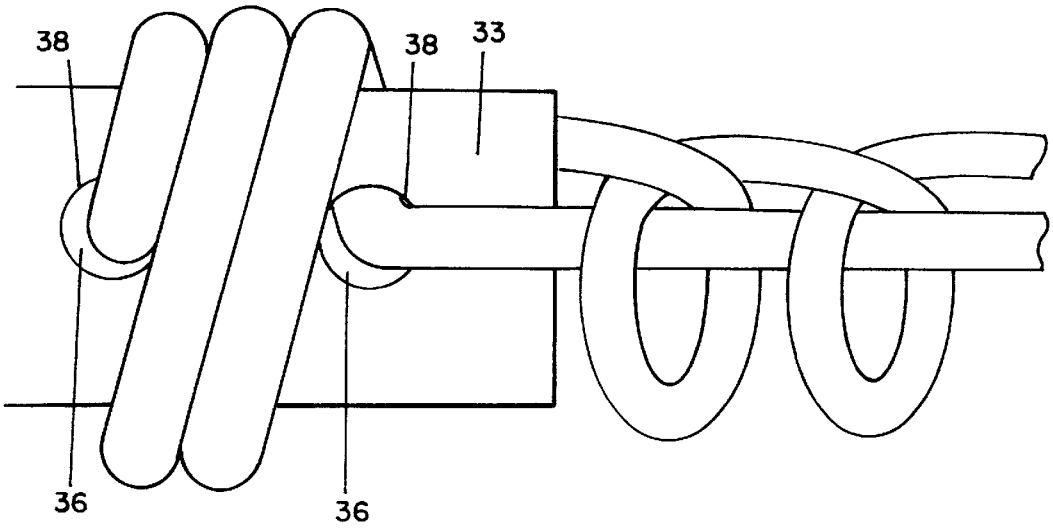
FIG. 10 illustrates a schematic side elevation of the bundle of gathered folds provided with holes.

Finally, each bundle of sixteen layers is folded together to form one bundle of gathered folds 33(thirty two layers of material), which is held by a clamp 34(FIG. 9) and fused by heat or bonded by an adhesive. Then, one or more holes 36 (FIG. 10) are cut or obtained by melting an aperture through the final bundle. A grommet 38 is provided for each hole 36.

Alternatively, an accordion type of folding can be used.

Attachment of each bundle of folds 33 to each suspending rope 22 can be achieved by joining suspending rope 22 directly to bundle 33 with a knot.

At the short side 32, corresponding to entrance slit 30, the process of folding is somewhat different to include an additional set of folds which provide a self-closing of entrance slit 30. This self-closing is activated and maintained by the weight of the occupant.

Here the sequence of folding is the following:

Edges 40 of entrance slit 30(FIG. 3), close to the corresponding short side 32, are folded together several times and held in place. Next follow the same operational steps(FIGS. 4 to 9), described for short side 32, opposite to entrance slit 30.

This folding, as described, of edges 40, prior to the folding of short side 32, produces, under the weight of the occupant, the self—closing of entrance slit 30.

The operation of other entrance through slit 30 takes place as follows:

The occupant either enters head first and turns around inside the hammock, or backs into the entrance until the back of his knees contact the low end of entrance slit 30. Then, the occupant sits down on bed 12, whose sheet 28 becomes tensioned.

As the occupant reclines against bed 12 and, as he lifts his legs off the ground, his entire weight is transmitted to bed 12. Lastly, the occupant lifts his legs through entrance slit 30, which closes under tension, providing a bug-proof environment. As said before, the self—closing is due to the fact that edges 40 of entrance slit 30 are folded together and held folded by the weight of the occupant.

A ridge line 42(FIGS. 11 to 13) extends in a vertical plane which includes longitudinal axis A of bed 12 and goes through each opposite bundle of gathered folds 33 and is attached to each suspending rope 22 or, alternatively, ridge line 42 can be attached to at least one of holes 36. Alternatively, when no holes are used, ridge line 42 could be attached directly to each bundle of gathered folds.

Optionally, ridge line 42 continues beyond its point of attachment at each opposite bundle of gathered folds 33 as suspending rope 22

Figure 11:
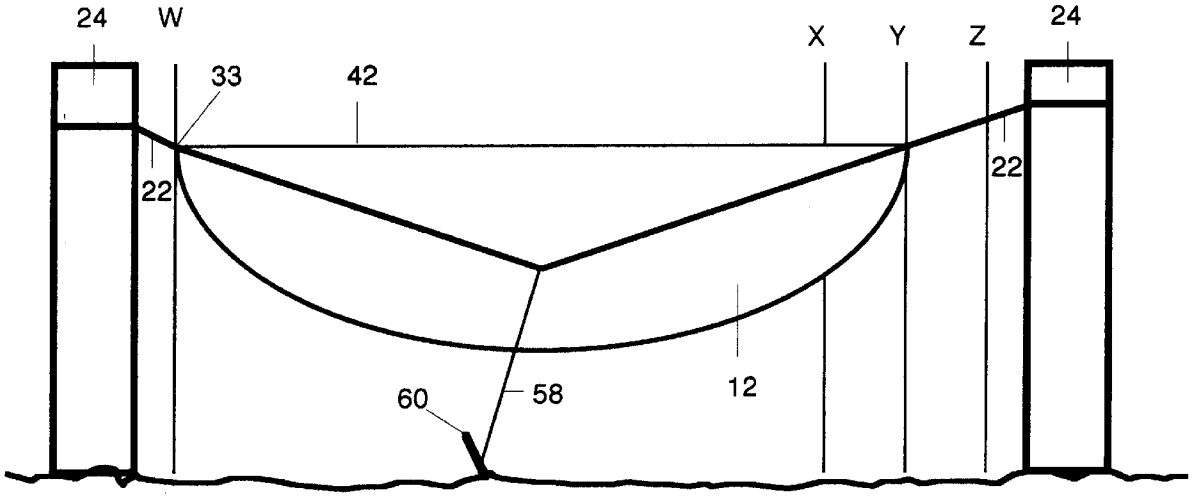
FIGS. 11 to 13 illustrates schematically side elevation of the bed using different adjustments of the ridge line for modifying the sag of the bed.
Figure 12:
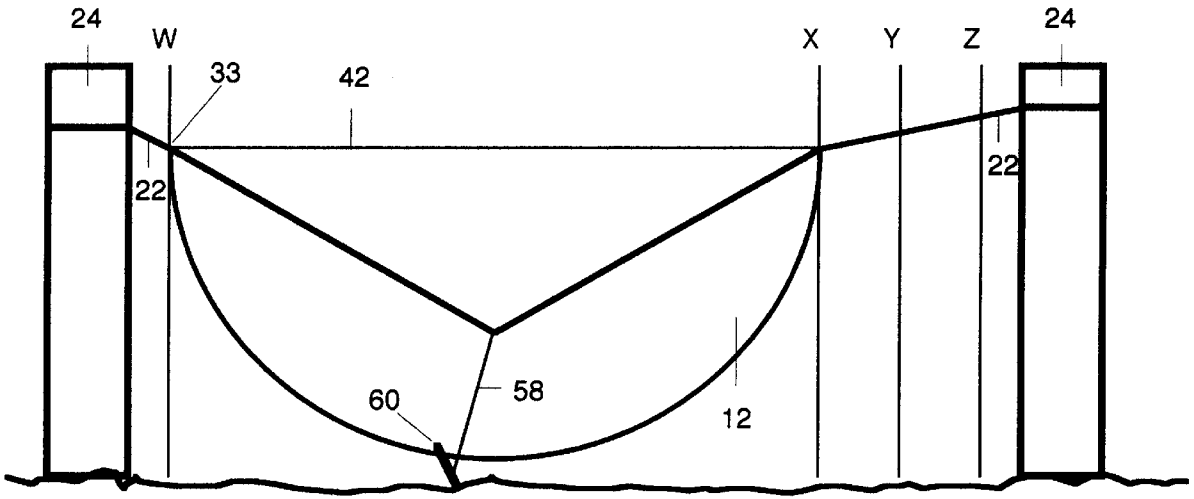
Figure 13:
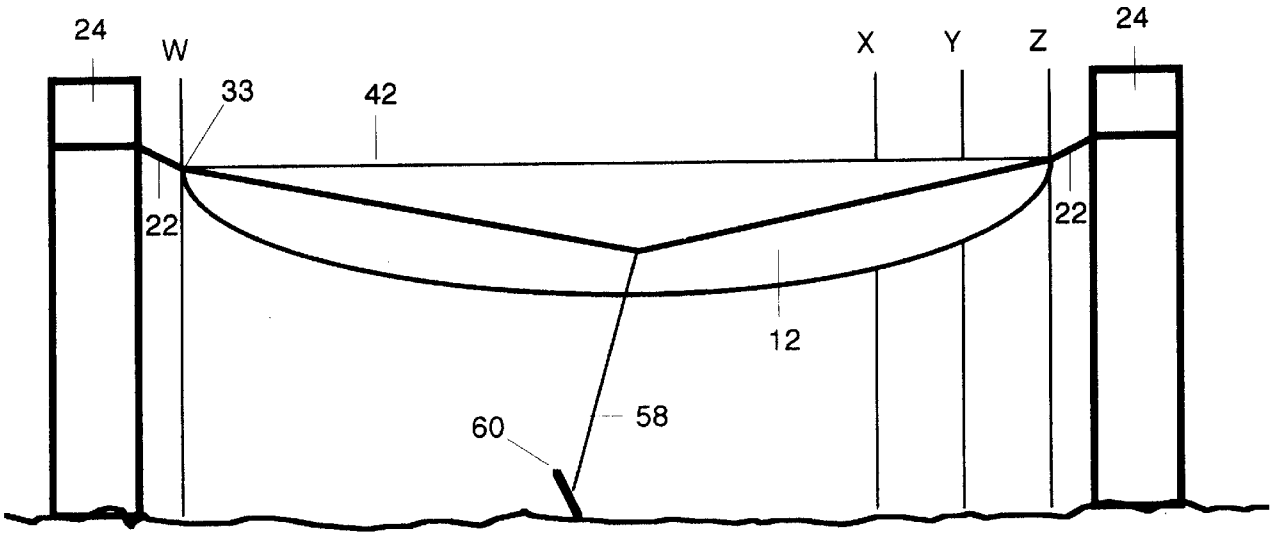
Figure 14:
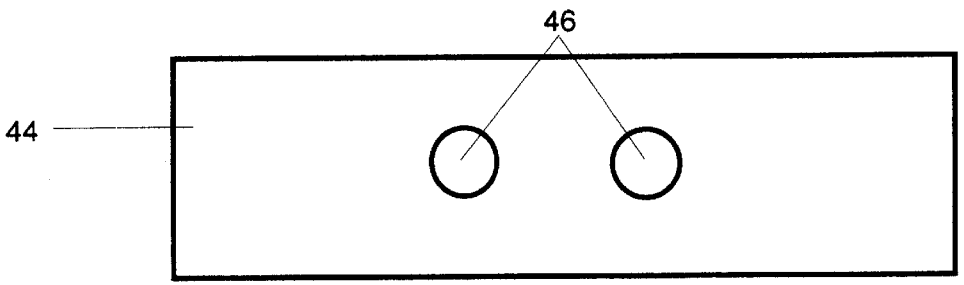
FIG. 14 illustrates schematically a side elevation of the sag adjustment device.
Figure 15:
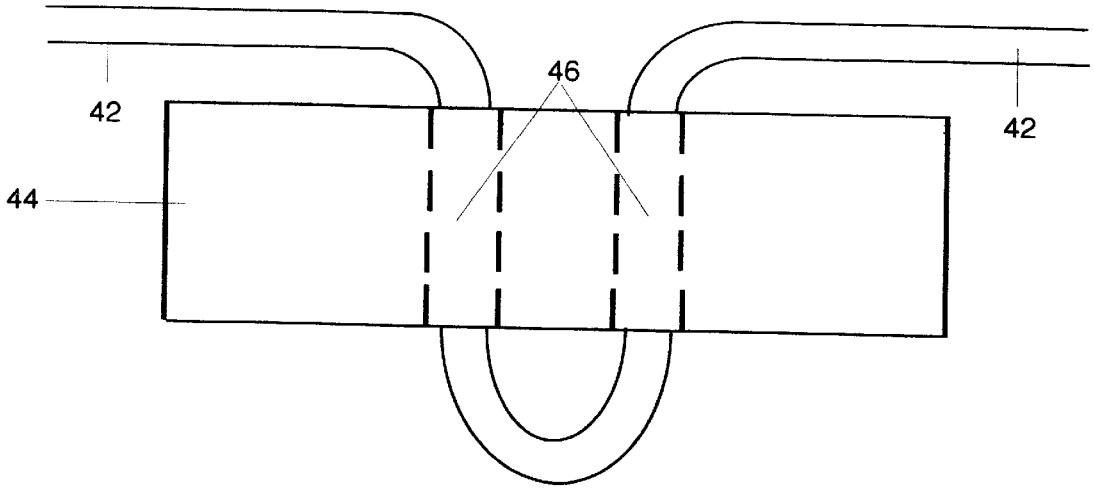
FIG. 15 illustrates schematically a side view elevation of the adjustment device with a slacked portion of the ridge line cord before wrapping.

In order to alter the sag of bed 12, according to individual comfort requirements, the workable length of ridge line 42 (FIGS. 11 to 13) is adjustable by untying one end of it and retying again to a shorter or longer length. As can be seen in FIGS. 11 to 13, three examples illustrate a comparison of different adjustments. The distance between anchors 4 is constant. On the left side of all three figures(FIGS. 11 to 13) there is one vertical line W which constitutes the line of reference. On the right side of all three figures are three vertical lines X, Y and Z.

The first example(FIG. 11) is an illustration of bed 12 with a ridge line 42, whose workable length has been preset at the factory for the comfort requirements of an average user. Notice that ridge line 42 terminates at line X, between Y and Z.

The second example(FIG. 12) is an illustration of bed 12, where ridge line 42 terminates at line Y. In this case the workable length of the ridge line is shorter and the sag bed in increased.

The third example(FIG. 13) illustrates bed 12 with a longer workable ridge line 42. Ridge line 42 now terminates at line Z. Thus its length is increased, but the sag of bed 12 is reduced.

Alternatively, a sag adjustment device 44 (FIGS. 14–17) is described. It has, in the presented embodiment, an elongated form with a circular cross section and two transversal holes 46. Ridge line 42 passes successively through both transversal holes 46 and a slackened portion 48 of ridge line 42 is left between exit 50 of first hole 46 and entrance 52 of second transversal hole 46.

Figure 16:
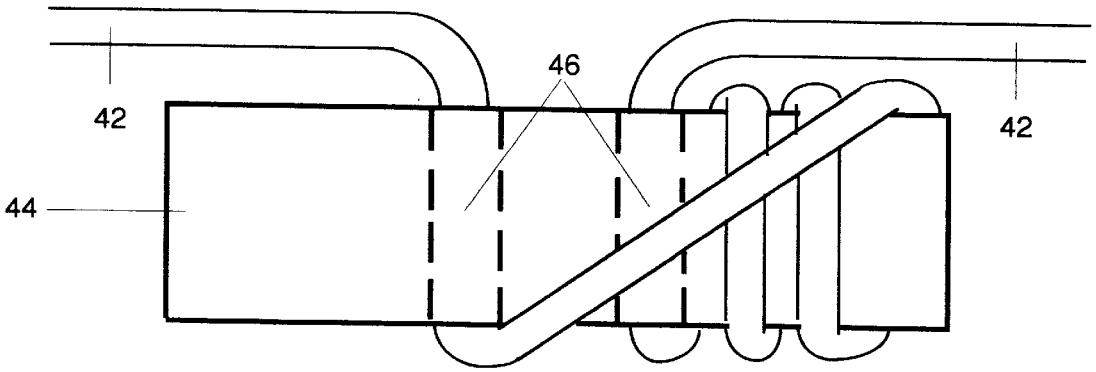
FIG. 16 illustrates schematically a side elevation view of the sag adjustment device wherein a portion of the ridge line cord is prewrapped at the factory.

The part of ridge line 42, which constitutes slacked portion 48, is wrapped, when ridge line 42 is not under tension, one or more times around either end of sag adjustment device 44. The extension of slacked portion 48 and, consequently, the resulting number of added or subtracted wraps has a direct influence on the final workable length of ridge line 52 and the corresponding amount of sag of bed 12, The adjustment, shown in FIG. 16, illustrates slacked portion 48, prewrapped at the factory to allow existing wraps to be unwrapped from or to allow additional wraps to be wrapped around sag adjustment device 44.

Figure 17:
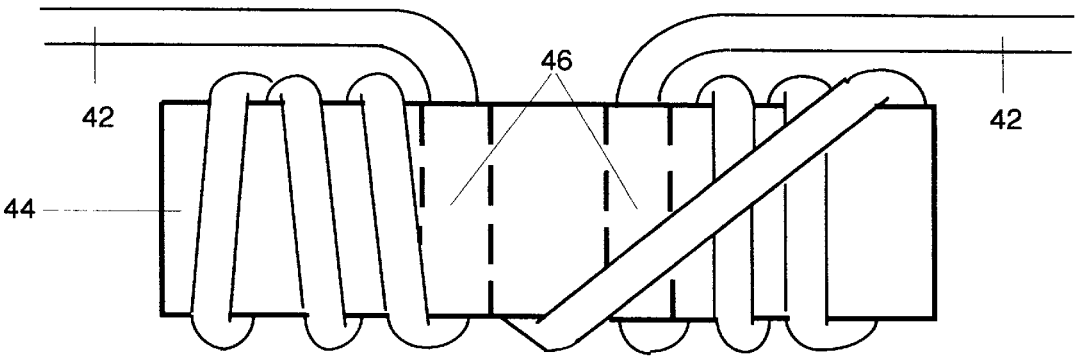
FIG. 17 illustrates schematically a side elevation view of the sag adjustment device with wraps added by the occupant to shorten the ridge line, hence to increase the sag.

The second adjustment, shown in FIG. 17, illustrates sag adjustment device 44 with additional wraps of ridge line 42, wrapped onto device 44 by the occupant of hammock 10, to shorten ridge line 42 and, hence, increase the sag of bed 12.

At approximately the middle of each longitudinal side 54 of rectangular sheet 28 (FIG. 3), respectively bed 12, an attachment element 56 is secured. Attachment element 56 is normally provided with a grommet(not shown). Through attachment element 56, a side adjustment cord 68 passes. The inner end of side adjustment cord 58 can be provided for length adjustment with a cord lock of known type (cord lock not shown). The outer end of side adjustment cord 58 is attached to a fixed element 60.

Insect net 14 is formed from a sheet of substantially lozenge shape of synthetic mesh type material. Polyester or nylon are usually used. Edges 16 of Insect net 14 are attached to longitudinal edges 18 of bed 12.

When opposite side adjustment cords 58 are outwardly stretched and suspending ropes 22 are tensioned, the shape of bed 12, viewed in plan, is a lozenge.

Canopy 26 is cut in a lozenge form from a sheet of synthetic material such as nylon or polyester.

An adjustably extendible cord 62, for each side of canopy 26, is attached with one side where two concurrent edges of the lozenge intersect transversal axis B. The other end of said adjustably extendible cord 62 is joined to a fixed feature 64.

Each two concurrent edges of the lozenge form sheet of canopy 26 at their point of intersection with longitudinal axis A is attached to a suspending 15rope 22. Each length of side adjustment cord 62 can be independently adjusted. Either side of canopy 26 may be flipped over and secured to the other side, to provide coverage on one side only. From that position, both sides of canopy 26 may be rolled together and stored above ridge line 42 and secured with a ring (not shown) slid from one end to the mid point of said canopy.

The embodiments of the invention in which an exclusive property or privilege is claimed are defined as follows:

1. A hammock comprising a bed comprising a piece of fabric, said fabric being gathered at opposite ends, each gathered end being secured to a rope which can be tied to a tree, said fabric having a longitudinal direction extending between said gathered ends, an entrance slit formed in the fabric, said slit substantially bisecting said fabric widthwise and extending in said longitudinal direction from a first point at one of said ends to a second point approximately midway between said ends, whereby, once the hammock is attached to a pair of trees, a person can enter the hammock from below by standing up through the slit and then reclining on an unslit portion of the fabric, the slit thereupon being closed by tension in the fabric resulting from the weight of the person thereon.

2. A hammock as defined in claim 1, wherein said piece of fabric is substantially rectangular before being gathered at opposite ends.

3. A hammock as defined in claim 1, wherein the ends of the piece of fabric are gathered by folding.

4. A hammock as defined in claim 1, further comprising a ridge cord extending between said ends, said cord having an effective length less that the length of said fabric, whereby, when the hammock is attached to a pair of trees, a certain minimum sag is maintained in the fabric no matter how tightly the ropes are drawn.

5. A hammock as defined in claim 4, wherein said cord and said ropes are continuous and unitary.

* * * * *